US005515887A

United States Patent [19]

Hanagasaki et al.

[11] Patent Number: 5,515,887

[45] Date of Patent: May 14, 1996

[54] WIRE REEL FOR USE IN A BINDING MACHINE

[75] Inventors: Hiroshi Hanagasaki; Ichirou Kusakari, both of Tokyo, Japan

[73] Assignee: Max Co., Ltd., Tokyo, Japan

[21] Appl. No.: 228,873

[22] Filed: Apr. 18, 1994

[30] Foreign Application Priority Data

Apr. 19, 1993 [JP] Japan ..... 5-025623 U

[51] Int. Cl.[6] ..... B21F 9/02

[52] U.S. Cl. ..... 140/119; 242/563; 242/613

[58] Field of Search ..... 242/563, 563.2, 242/912, 613, 588.6; 140/57, 119

[56] References Cited

U.S. PATENT DOCUMENTS

| | | | |
|---|---|---|---|
| 2,435,086 | 1/1948 | Lack | 242/613 |
| 3,292,170 | 12/1966 | D'Angelo | 242/563.2 |
| 4,190,216 | 2/1980 | Kluczynski et al. | 242/613 |
| 4,236,449 | 12/1980 | Price | 242/563 |
| 4,286,487 | 9/1981 | Rubel | 242/563 |
| 4,834,148 | 5/1989 | Muguruma et al. | 140/119 |
| 4,865,087 | 9/1989 | Geiger | 140/119 |
| 4,878,607 | 11/1989 | Lessard | 242/563 |
| 5,279,336 | 1/1994 | Kusakari et al. | 140/57 |

FOREIGN PATENT DOCUMENTS

| | | | |
|---|---|---|---|
| 4012487A | 1/1979 | Japan | 242/563 |
| 4012488A | 1/1979 | Japan | 242/912 |
| 3241744A | 7/1988 | Japan | 242/912 |
| 1-145969A | 6/1989 | Japan | 242/563.21 |
| 1-167010A | 6/1989 | Japan | 242/563.21 |

*Primary Examiner*—Daniel P. Stodola
*Assistant Examiner*—William A. Rivera
*Attorney, Agent, or Firm*—Cushman Darby & Cushman

[57] ABSTRACT

A wire reel (3) for winding a binding wire thereround includes, on the outside surface of at least one of two frame plates, a recessed portion (15) consisting of a peripheral wall portion (14) having its center at the axis of the reel and a bottom wall portion (12). An optical sensor detection mark (17) is provided in the recessed portion (15) such that the mark (17) is disposed eccentric from the axis of the reel. The peripheral wall portion (14) of the recessed portion (15) is formed as a rotary shaft portion which is rotatably supported by the reel support portion of a binding tool. Since the recessed portion (15) is completely covered by the reel support portion of the binding tool, the optical sensor detection mark (17) provided in the recessed portion (15) is completely free from the influences of the external environment. Thus, even if the weather and indoor or outdoor operation sites using the binding tool and the like vary, the rotation of the wire reel (3) can be detected accurately to thereby effectively prevent operation errors.

3 Claims, 4 Drawing Sheets

WIRE REEL FOR USE IN A BINDING MACHINE

BACKGROUND OF THE INVENTION

1. Field of the Invention

The present invention relates to a reel for holding binding wire. The reel with the binding wire is mounted to a binding tool which is used to bind objects of interest. Specifically, the wire contained on the reel is fed to the binding tool which cuts and twists the wire around architectural reinforcing bars.

2. Description of the Related Art

In reels of this type, the connection of the terminal end of the wire held on the reel is used to control the rotation of the reel. Thus, if the terminal end of the wire held on the reel is not directly connected to the reel, the reel cannot be rotated, In this method, the ability of the reel to rotate is used to determine whether or not all the wire on the reel has been used in the binding operations. Thus, when the reel can no longer be rotated, the wire supply on the reel has been exhausted. When the wire supply has been exhausted, the binding process is then brought to a stop.

In order to simplify the process for determining when the supply of wire has been exhausted and for bringing the binding operation to a stop, an optical sensor system may be used. Reflected light through a detection mark formed on the side surface of the reel may be detected by an optical sensor. The optical sensor system consists of a light emitting element and a light receiving element respectively disposed opposite each other in the reel support portion of the binding tool.

However, because tools such as a binding tool and the like are used in a variety of lighting conditions, detection errors with the optical sensor system caused by the differences in the light intensities in different environments cannot be avoided. For example, differences in light intensities between the outdoors and various lighting conditions indoors frequently result in erroneous readings in the optical sensor system attached to such binding tools. Such erroneous readings can interfere with the operation of the binding tool and thereby prevent the stable operation of the binding process.

SUMMARY OF THE INVENTION

It is in an object of the present invention to provide a wire reel which allows the rotation of the reel to be detected with certainty without the influence of variable environmental lighting conditions on the binding process.

In attaining the above object, according to the present invention, there is provided a wire reel for use in a binding tool for binding reinforcing bars and the like by use of a binding wire to be wound round the wire reel, in which a recessed portion, consisting of a peripheral wall portion and a bottom wall portion and having its center on the central axis of said reel, is formed on the outside surface of at least one of two frame plates provided in the wire reel, an optical sensor detection mark is provided eccentrically from the axis of the reel on the bottom wall portion surface of the recessed portion, and the peripheral wall portions of the recessed portion are formed as a rotary shaft portion to be supported rotatably in the reel support portion of the binding tool for binding reinforcing bars and the like.

According to the above-mentioned structure, since the wire reel includes the recessed portion serving as the rotary shaft, by providing a cover portion for the opening of the recessed portion and an optical sensor in the reel 10 support portion of the binding tool, the interior of the recessed portion can be shielded completely from the outside by the recessed portion itself and the cover portion of the reel support portion of the binding tool. This shielding completely eliminates the influence of external environmental lighting conditions on the optical sensor detection system. Therefore, even if the weather and/or outdoor or indoor operation sites using the binding tool and the like vary, the rotation of the wire reel can be detected with accuracy to thereby effectively eliminate or prevent the occurrence of operational errors.

The following references numbers are used throughout the figures:

1 Main body portion of binding tool,
2 Guide portion of the binding tool,
3 Wire reel,
**3*a*** Disk-shaped frame plate of reel,
**3*b*** First cylinder portion of wire reel,
4 Wire,
5 Wire guide hole of binding tool,
6 Feed mechanism of binding tool,
7 Cutting mechanism of binding tool,
8 Twisting mechanism of binding tool,
9 Hook,
10 Wire reel mounting arm of binding tool,
11 Wire reel mounting arm of binding tool,
12 Bottom wall portion of wire reel,
13 Second cylinder portion of reel,
14 Peripheral wall portion of reel,
**14*a*** Inner peripheral wall portion,
**14*b*** Outer peripheral wall portion,
15 Recessed portion of reel,
16 Radially extending ribs,
17 Optical sensor detection mark,
18 Support shaft of binding tool,
**18*a*** Enlarged head portion of shaft,
19 Spring,
21 Annular projection,
22 Optical sensor,
23 Control board for the optical sensor,
24 Control part,
30 Object to be bound and
40 Space portion.

DETAILED DESCRIPTION OF THE PREFERRED EMBODIMENTS

Figure 1:
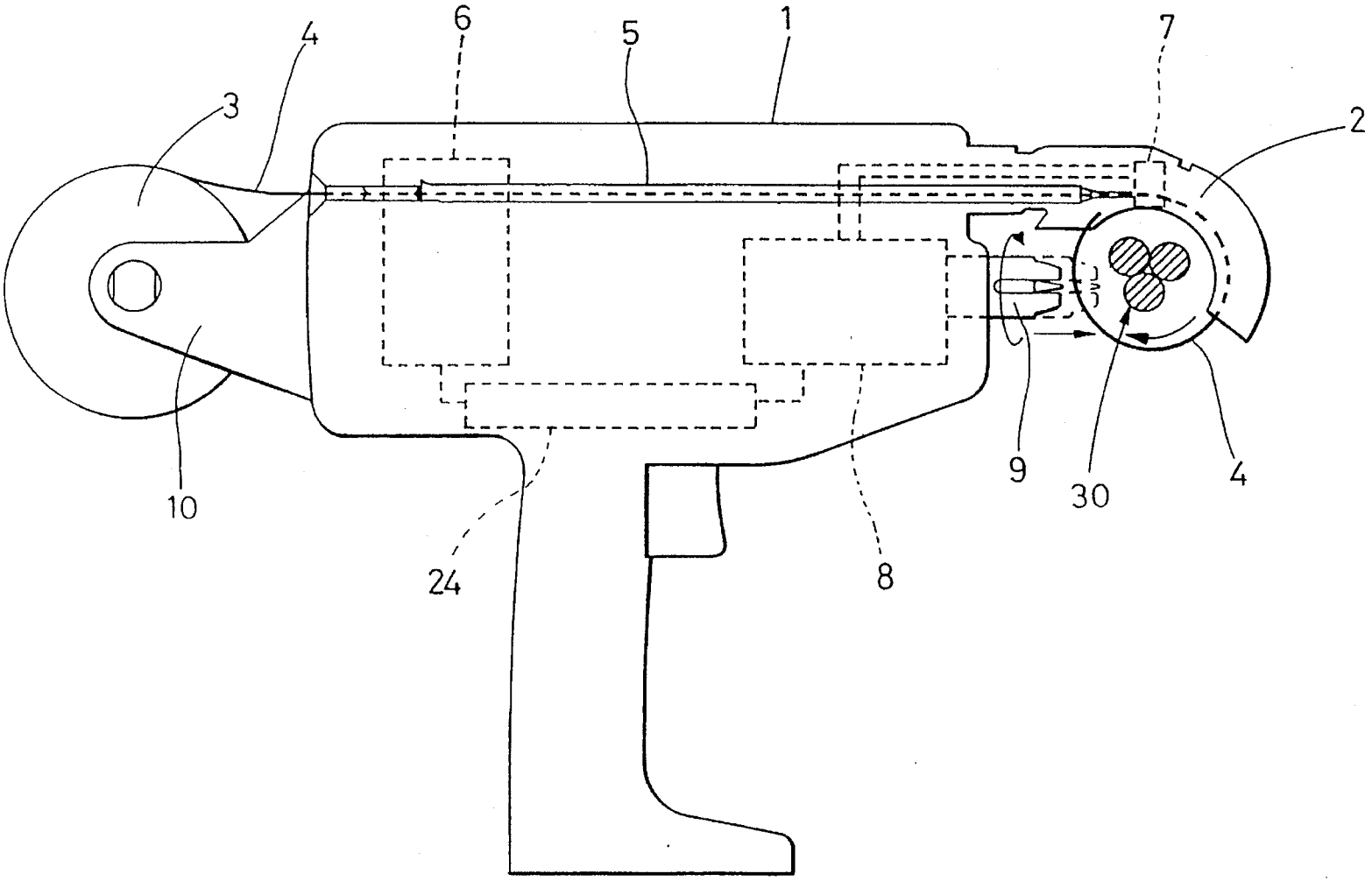
FIG. 1 is a structural view of a binding tool according to the present invention.

FIG. 1 shows a binding tool, in which reference character 1 designates the main body portion of the binding tool, 2 represents a guide portion of the binding tool and 3 represents a reel around which a binding wire 4 is wound. The main body portion 1 of the binding tool includes a wire guide hole 5 through which the binding wire 4 is extended longitudinally, and also includes a feed mechanism 6 for extruding the wire 4 from the wire reel 3 and feeding the wire 4 to the guide portion 2, a cutting mechanism 7 for cutting the feed wire 4 at the front end guide outlet of the wire guide hole 5, and a twisting mechanism 8 for hitching a hook 9 round the wire 4 wound around an object 30 to be bound, such as a reinforcing bar and the like, by the guide portion 2 and twisting of the hook 9.

Figure 2:
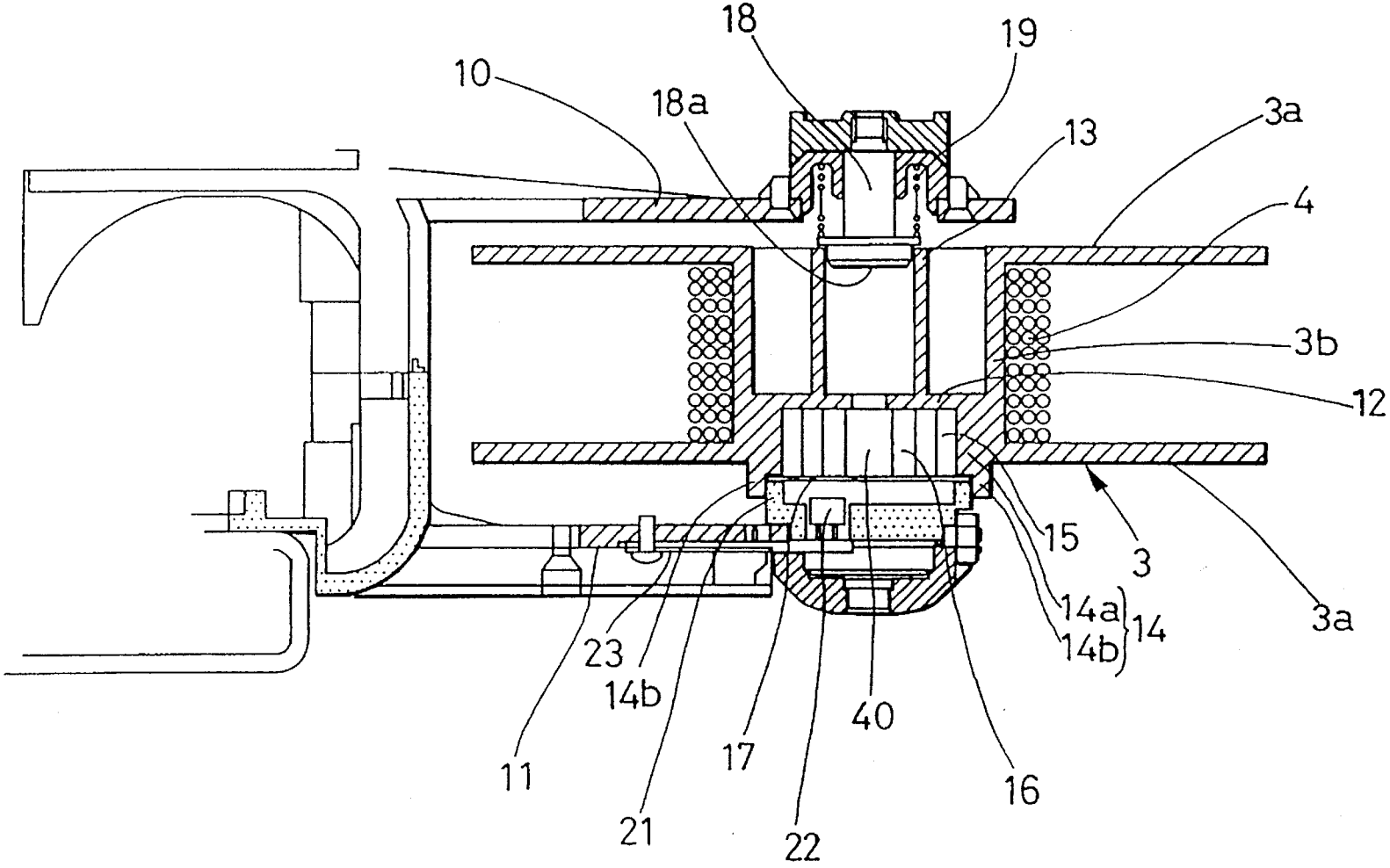
FIG. 2 is an enlarged transverse section view of the rear portion of the binding tool.

In FIG. 2, a pair of wire reel mounting arms 10 and 11 are provided projectingly on and from the main body portion 1 of the binding tool, and the wire reel 3 with the binding wire 4 wound thereround is removably and rotatably supported between the arms 10 and 11.

The wire reel 3 is comprised of a pair of disk-shaped frame plates 3*a* and a first cylinder portion 3*b* connecting the two frame plates 3*a*. A bottom wall partition 12 is formed within the cylinder portion 3*b* of the reel in the middle of the cylinder portion 3*b*. A second cylinder portion 13 having a diameter smaller than that of the first cylinder portion 3*b* is connected to one of the frame plates 3*a*. A recessed portion 15 of the reel is formed by a wall portion defined by a bottom partition wall 12 and a peripheral wall portion 14. The recessed portion 15 has its center at or on the central axis of the reel 3. Radially extending ribs 16 are provided on and from the bottom wall portion 12, and an optical sensor detection mark 17 is provided on the leading end face of one of the ribs 16 in such a manner that it is eccentric from the central axis of the reel 3. The peripheral wall portion 14 comprises two parts, that is, an inner peripheral wall portion 14*a* having a small diameter and an outer peripheral wall portion 14*b* having a larger diameter.

Next, the small diameter second cylinder portion 13 provided on the one frame plate 3*a* of the bottom wall partition 12 of the wire reel 3 and the peripheral wall portion 14 formed on the other frame plate of the partition wall 12 are respectively arranged as a rotary shaft portion with respect to the binding tool.

That is, inside the leading end of arm 10 projecting backwardly of the main body portion 1 of the binding tool, there is provided a support shaft 18 as a wire reel support portion which is projected toward wire reel mounting arm 11 and is movable in the axial direction. The wire reel support shaft 18 is energized in the projecting direction thereof by a spring 19 and is also arranged such that the enlarged head portion 18*a* provided in the leading end thereof can be fitted with the small diameter second cylinder portion 13 of the wire reel 3 to support the wire reel 3 rotatably.

On the other hand, inside the leading end of wire reel mounting arm 11, there is provided a an annular projection 21 having a recess-shaped section as a wire reel support portion. The annular projection 21 is fitted within the interior of the large diameter outer peripheral wall portion 14*b* of the wire reel 3 to support the wire reel rotatably.

The annular projection 21 covers the opening of the recessed portion 15 of the wire reel 3. Therefore, by means of the peripheral wall portion 14 and bottom wall portion 12 forming the recessed portion 15 and the annular projection 21 of the reel support portion, there is formed in the interior of the recessed portion 15, a space portion 40 which is completely covered from the outside.

To mount the wire reel 3 onto the main body portion 1 of the binding tool, the reel 3 is inserted between the wire reel support portions of the main body portion 1 of the binding tool, i.e., between support shaft 18 and annular projection 21. The wire reel support shaft 18 is drawn in against the energizing force of the spring 19, the wire reel 3 is inserted between the two arms 10 and 11 and the annular projection 21 is fitted into the large diameter peripheral wall portion 14 of the wire reel 3. The wire reel support shaft 18 is then projected out by the spring 19 and is fitted within the small diameter second cylinder portion 13 of the wire reel 3.

Figure 3:
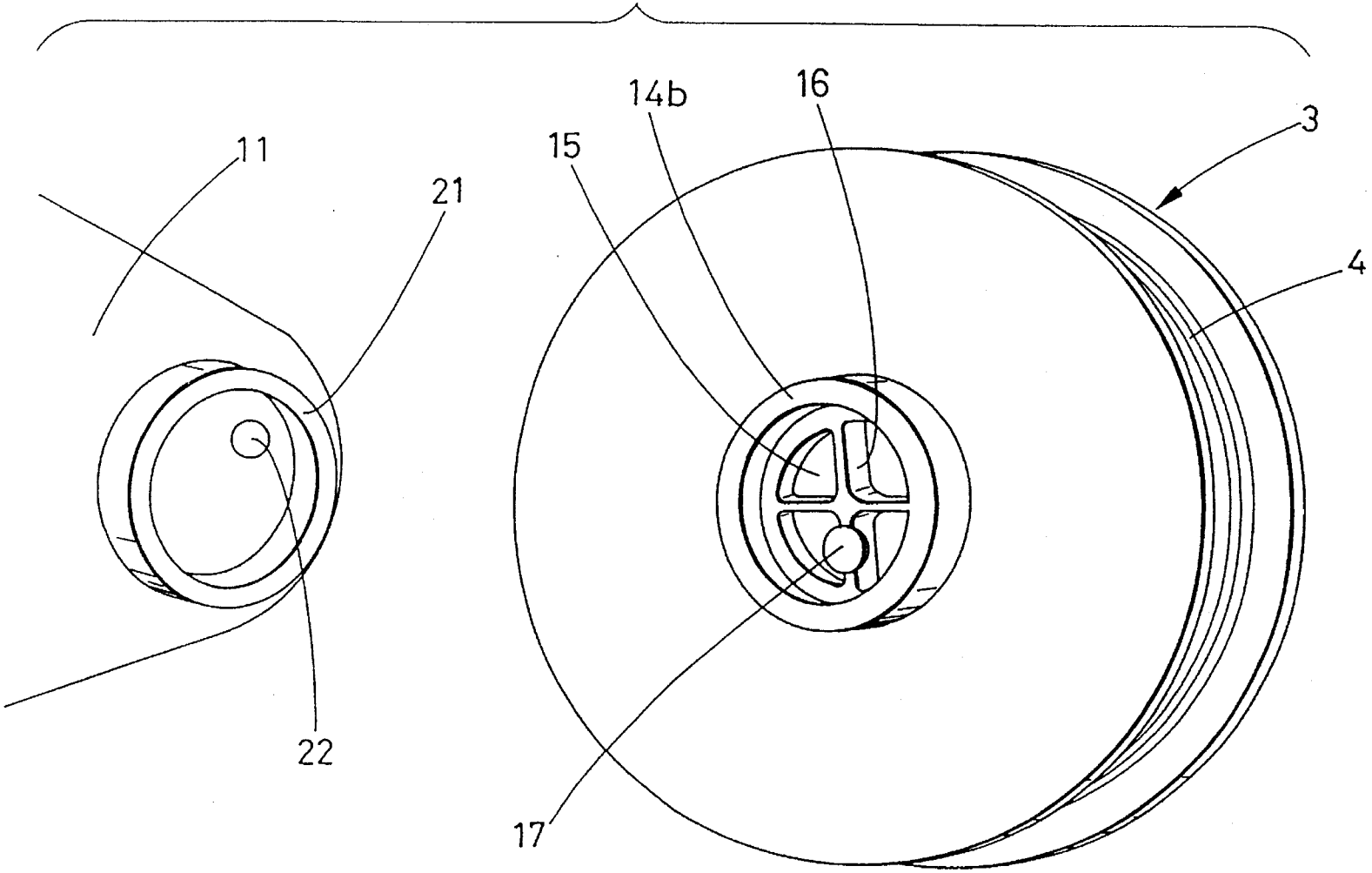
FIG. 3 is a perspective view of a wire reel and a wire reel support portion of the binding tool.

In FIG. 3, within the annular projection 21 of the wire reel support portion of the wire reel mounting arm, there is disposed an optical sensor 22 consisting of a light emitting element and a light receiving element in such a manner that it can correspond to the moving locus of the optical sensor detection mark 17 of the wire reel 3. Reference character 23 designates a control board for the optical sensor 22. The control board 23 controls the optical sensor 22 such that the optical sensor 22 can operate only while the feed mechanism 6 of the binding wire 4 is operating, and also outputs a pulse signal to a control part 24 in the main body portion 1 of the binding tool when the optical sensor 22 detects light reflected from the optical sensor detection mark 17 of the wire reel 3.

Figure 4:
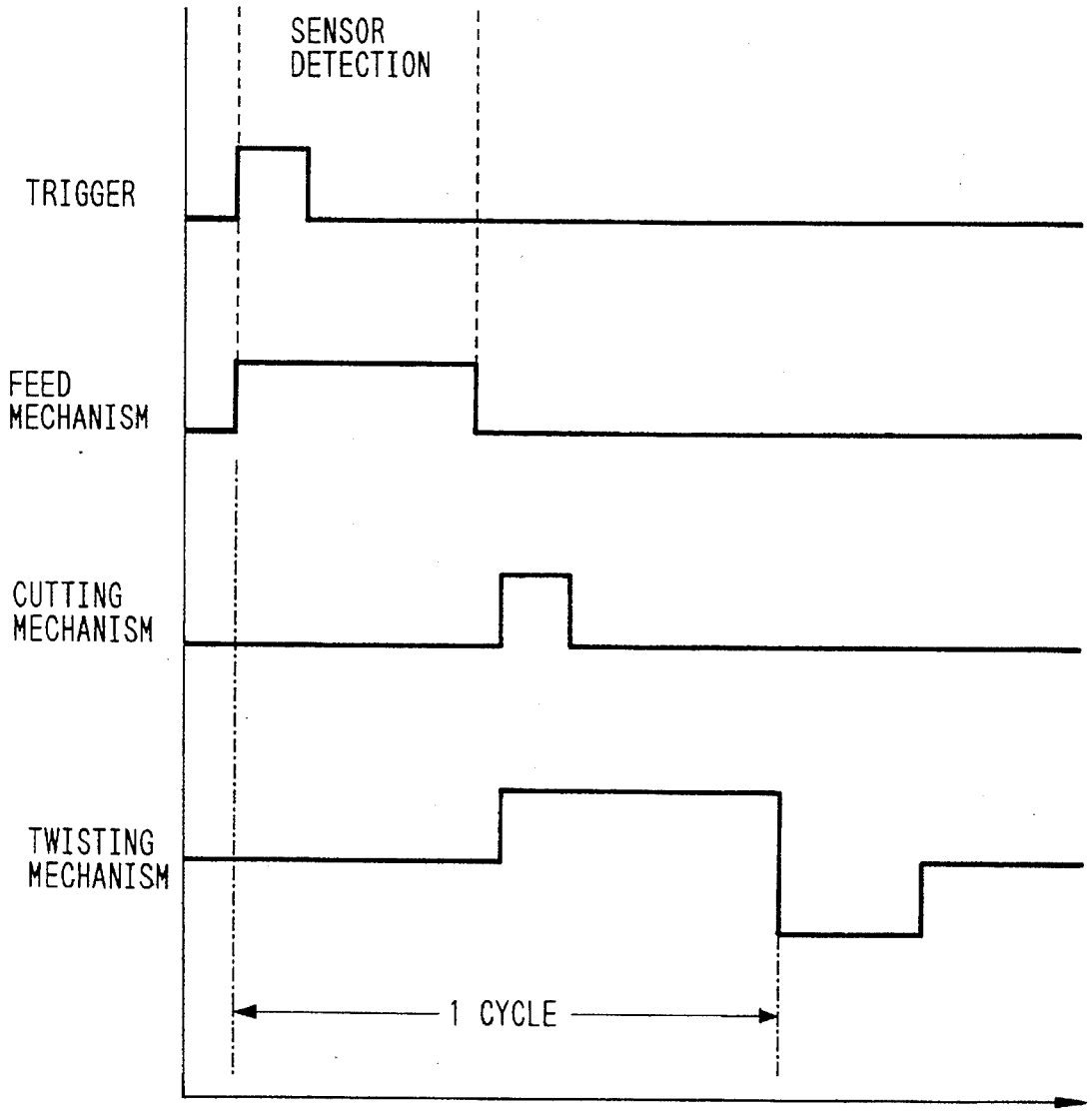
FIG. 4 is a timing chart of the respective drive mechanisms, including the trigger, feed mechanism, cutting mechanism and twisting mechanism for one cycle of the process with the binding tool containing the optical sensor and the reel containing the optical sensor detection mark of the present invention. Vertical line elevation indicates activation of a given mechanism and a vertical drop indicates a termination of a given process. The horizontal lines indicate time.

The control part 24 controls the operations of the feed mechanism 6, cutting mechanism 7 and twisting mechanism 8. Specifically, as shown in the timing chart in FIG. 4, the control part 24 at first operates the feed mechanism 6 for a given period of time to allow the guide portion 2 to guide and wrap around the wire 4 into a loop shape and wind the loop wire 4 around the object 30 to be bound, such as a reinforcing bar and the like. The control part 24 the operates the cutting mechanism 7 to cut the wire 4 and the twisting mechanism 8 to strongly bind the object 30 to be bound. In addition to this, when a pulse signal from the optical sensor 22 is sent to the control part 24, the control part 24 operates the respective drive mechanisms continuously and, when any pulse signal is not received during the operation time of the feed mechanism 6, then the control part 24 immediately stops the operation of the cutting mechanism following the feed mechanism 6.

According to the above description, in a normal wire binding operation, wire 4 is extruded from the wire reel 3 when the feed mechanism 6 is being operated. Thus, wire reel 3 is rotated around the axis of the above-mentioned rotary shaft portions (13, 14). In this case, since the optical sensor detection mark 17 of the wire reel 3 is sure to face the optical sensor 22 within the operation time of the feed mechanism 6, the optical sensor 22 will detect the reflected light from the optical sensor detection mark 17. Therefore, following the operation of the feed mechanism 6, the cutting mechanism 7 and twisting mechanism 8 are operated, so that the object 30 to be bound will be bound.

On the other hand, when the amount of wire 4 on the wire reel 3 is depleted, exhausted or used up, the wire reel 3 ceases to rotate and at the same time the optical sensor detection mark 17 also stops rotating. In this case, since the 10 optical sensor detection mark 17 does not move to a position facing the optical sensor 22, the optical sensor 22 cannot detect the reflected light from the optical sensor detection mark 17 and thus no pulse signal is emitted or sent out. If no pulse signal from the optical sensor 22 is received by the control part 24, then the cutting mechanism 7 following the feed mechanism 6 is forced to stop. Therefore, an operator is able to know that the supply of wire 4 has been depleted and at the same time the last piece of binding wire 4 is not cut but remains as it is moved out from the front portion of the binding tool. Thus, if the wire 4 is pulled out from the front portion, then the wire 4 within the wire guide hole 5 of the binding tool can be removed.

Also, because the recessed portion 15 of the wire reel 3 is covered completely from outside by the cover portion (annular projection 21) of the reel support portion of the binding tool, the optical sensor detection mark 17 within the recessed portion 15 is completely free from the influences of the external environment. For this reason, even if the weather and indoor or outdoor operation sites using the binding tool and the like vary, the rotation of the wire reel 3 can be detected accurately to thereby effectively prevent occurrences of operation errors.

It is also expected that the optical sensor detection mark 17 of the wire reel 3 can stop at a position facing the optical sensor 22. Accordingly, it is preferable that the optical sensor 22 is set not to output the pulse signal in this case as well.

The number of the optical sensor detection marks 17 is not limited to 1. Two or more optical sensor detection marks 17 can be used, or they may be located on both sides of the wire reel 3. Also, the annular projection 21 of the reel support portion of the binding tool may be arranged such that it can be fitted with the outside of the peripheral wall portion 14 of the recessed portion 15 of the wire reel 3.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

Thus, it is to be understood that variations in the particular shape and configuration of the disclosed wire reel can be made without departing from the novel aspects of this invention as defined in the claims.

What is claimed is:

1. A binding tool comprising: a reel disposed at a first end of said binding tool for holding wire and for feeding the wire during operation of a binding process; means for feeding the wire from said reel through said binding tool; a cutting mechanism disposed along the wire path for cutting the wire; a twisting mechanism disposed at a second end of said binding tool for twisting the cut wire around an object to be wound; said reel including:

a reel body, having two frame plates, on which the wire is wound;

a recessed portion including a peripheral wall portion and a bottom wall portion, said recessed portion formed on at least one of said two outer surfaces of said reel body;

an annular projection having a recess-shaped section inserted into said peripheral wall portion for rotatably supporting said reel body;

an optical sensor disposed within the recess-shaped section of said annular projection, for detecting rotation of said reel body; and at least one optical sensor detection mark disposed in said recessed portion so that environmental lighting conditions do not influence operation thereof.

2. The binding tool of claim 1, wherein the reel further comprises:

said reel includes a central axis, said recessed portion has a center thereof on said central axis of said reel, said optical sensor detection mark is disposed in said recessed portion in such a manner that said optical sensor detection mark is disposed eccentric from said central axis, and said peripheral wall portion of said recessed portion is formed as a rotary shaft portion which is rotatably supported by a reel support portion of a binding tool for binding a reinforcing bar.

3. The binding tool of claim 1, wherein the reel further comprises:

(a) a pair of disk-shaped frame plates and (b) a first cylinder portion connecting said disk-shaped frame plates, said reel having a central axis, one of said pair of disk-shaped frame plates incorporated in a second cylinder portion, said first cylinder portion having a bottom partition wall and a peripheral wall portion, said bottom partition wall and said peripheral wall portion forming a recessed portion of said reel, said recessed portion having a center and said optical sensor detection mark, said center of said recessed portion being situated on the central axis of said reel and said optical sensor detection mark disposed eccentric from said central axis of said reel, said bottom partition wall having opposite sides with said second cylinder portion attached on one side and said peripheral wall portion attached on said opposite side, said second cylinder portion, said bottom partition wall and said peripheral wall portion arranged to form a rotary shaft portion, said reel rotatably connected to said binding tool by said rotary shaft portion.

* * * * *